US006240562B1

(12) United States Patent
Martin

(10) Patent No.: US 6,240,562 B1
(45) Date of Patent: Jun. 5, 2001

(54) SHAWL TYPE GARMENT

(75) Inventor: Joan Martin, 14020 Captain's Row, #305, Los Angeles, CA (US) 90292

(73) Assignee: Joan Martin, Marina Del Rey, CA (US)

( * ) Notice: Subject to any disclaimer, the term of this patent is extended or adjusted under 35 U.S.C. 154(b) by 0 days.

(21) Appl. No.: 09/413,575

(22) Filed: Oct. 6, 1999

Related U.S. Application Data

(60) Provisional application No. 60/103,164, filed on Oct. 6, 1998.

(51) Int. Cl.[7] ..... A41D 3/08
(52) U.S. Cl. ..... 2/88
(58) Field of Search ..... 2/88, 90, 92, 93, 2/96, 207, 309, 311, 144

(56) References Cited

U.S. PATENT DOCUMENTS

D. 275,811 * 10/1984 Kaigler ..... 2/43
2,639,431 * 5/1953 Spear ..... 2/88
2,782,619 * 2/1957 Bialostok ..... 66/176
3,602,914 * 9/1971 Castello ..... 2/90
4,649,573 * 3/1987 Yen ..... 2/74

* cited by examiner

*Primary Examiner*—John J. Calvert
*Assistant Examiner*—Alissa L. Hoey
(74) *Attorney, Agent, or Firm*—Marvin H. Kleinberg; Kleinberg & Lerner, LLP

(57) ABSTRACT

A novel shawl type garment is fabricate to simulate a sweater worn as a shawl or mantle and includes a main body panel and a pair of ties that simulate sweater arms. The garment may be made of woven or knitted fabric and may be either single or double layered. The garment is cut to minimize cupping at the bottom edge and can include trim buttons and button holes to simulate a cardigan sweater in an alternative embodiment.

20 Claims, 2 Drawing Sheets

SHAWL TYPE GARMENT

The present application is a continuation-in-part application claiming the priority of copending provisional application Ser. No. 60/103,164, filed Oct. 6, 1998.

The present invention relates to garments and, more particularly, a shawl type garment that is intended to be worn over other clothing.

BACKGROUND OF THE INVENTION

1. Field of the Invention

Frequently, when wearing informal clothing, such as sportswear, a sweater may be carried in case the weather becomes cooler and the informal clothing being worn lacks sufficient warmth for comfort. Until the need for the sweater, however, the sweater may be draped over the shoulders or the arms of the sweater may be tied about the waist so that the sweater need not be kept in the hands or arms of the wearer.

2. Description of the Related Art

For many years, a sweater, so worn, has represented a fashion statement. Many people like the informal look that is created but are not pleased with the bulk of the sweater as a shawl or body drape. Neither are they satisfied with the bulk of the knot that results when the arms are tied together to keep the sweater in place.

SUMMARY OF THE INVENTION

According to the present invention, a garment is created which can create the casual look of a draped or tied sweater, but without the bulk at the "arms" and cut in a way that is more flattering to the figure when worn tied about the waist.

The garment of the present invention can be made of virtually any fabric, either woven or knit and can be made in a single thickness or in a double thickness. It may have decorative patterns woven in or appliqued. Yet other decorations can be embroidered or sewn on as a patch. Further, the garment can be made reversible so that a different color or other look is presented when reversed.

The garment is created by cutting the fabric approximately ¾ inch off grain of the straight of goods so that the garment drapes slightly off of the line of the straight of goods causing the garment not to "cup" in at the bottom. This allows for a more flattering and slimming look to the wearer's backside.

To enhance a slimming effect, darts can be placed at the top of the panel. The ties are made of the same fabric and can be either single or double thickness but narrower than a sleeve would be and slightly longer to enable a smooth, non bulky fastening when the ends are tied together, either in a knot or merely in a simple over and under closure.

Accordingly, it is in object of the present invention to provide a garment that can be worn over as a drape or shawl over the body independent of other clothing, either for added warmth or merely as a fashion element.

It is an additional object of invention to provide a fashionable garment that resembles a sweater but without the bulk and awkwardness of a sweater when tied.

It is yet another object of invention to provide a shawl or drape type garment that can be flattering to the figure when worn about the waist and covering the seat.

The novel features which are characteristic of the invention, both as to structure and method of operation thereof, together with further objects and advantages thereof, will be understood from the following description, considered in connection with the accompanying drawings, in which the preferred embodiment of the invention is illustrated by way of example. It is to be expressly understood, however, that the drawings are for the purpose of illustration and description only, and they are not intended as a definition of the limits of the invention.

DESCRIPTION OF THE PREFERRED EMBODIMENTS

Figure 1:
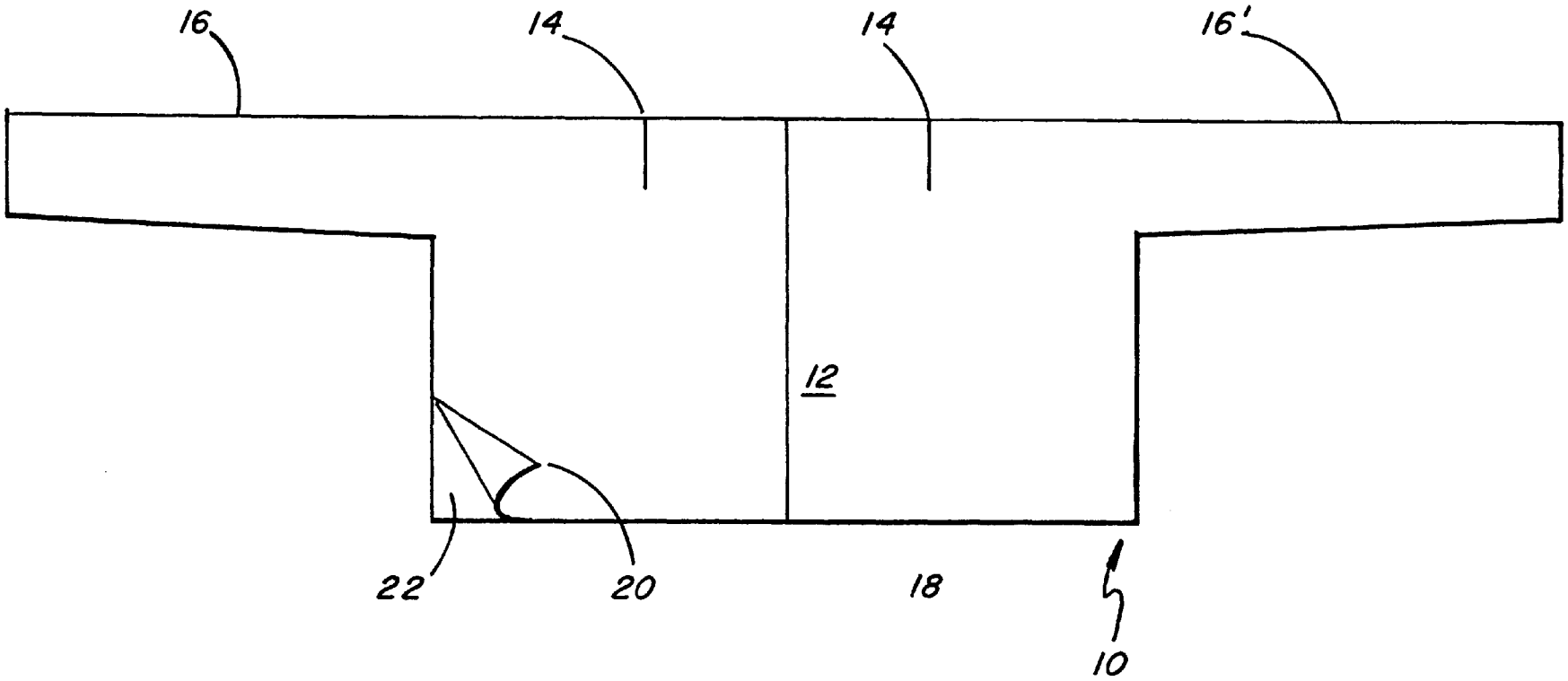
FIG. 1 is a plan view of a pattern of a preferred embodiment of the garment of the present invention.

Turning first to FIG. 1, there is shown in plan view, a pattern 10 for a garment according to the present invention. The same basic pattern 10 can be used for single and double thickness garments. A rectangular body panel 12 is the starting point for the garment. In the preferred embodiment for a medium size, the panel is approximately 30" wide and 17" long.

As shown, optional darts 14 can be placed approximately 6" from the centerline of the main body panel 12. A pair of ties 16, 16' are fastened to the top of the body panel 12 and are tapered from a width of 5" at the point of attachment to a width of 4" at the end. Each tie 16, 16' is approximately 18" in length.

When using two layers of fabric, it is preferable that the top and sides of the body panel 12 be sewn or seamed together. The bottom edges 18 should be finished, but not sewn together. When finished, the garment, when worn, would resemble a pullover sweater. In FIG. 1, on corner 20 of the upper layer is folded back to reveal the lower layer 22.

The garment can be worn over the shoulders or at the waist. If worn over the shoulders, the ties 16, 16' should be loosely tied together. If worn at the waist, the ties 16, 16' should be fastened more tightly to prevent the garment from sliding over the hips.

Figure 2:
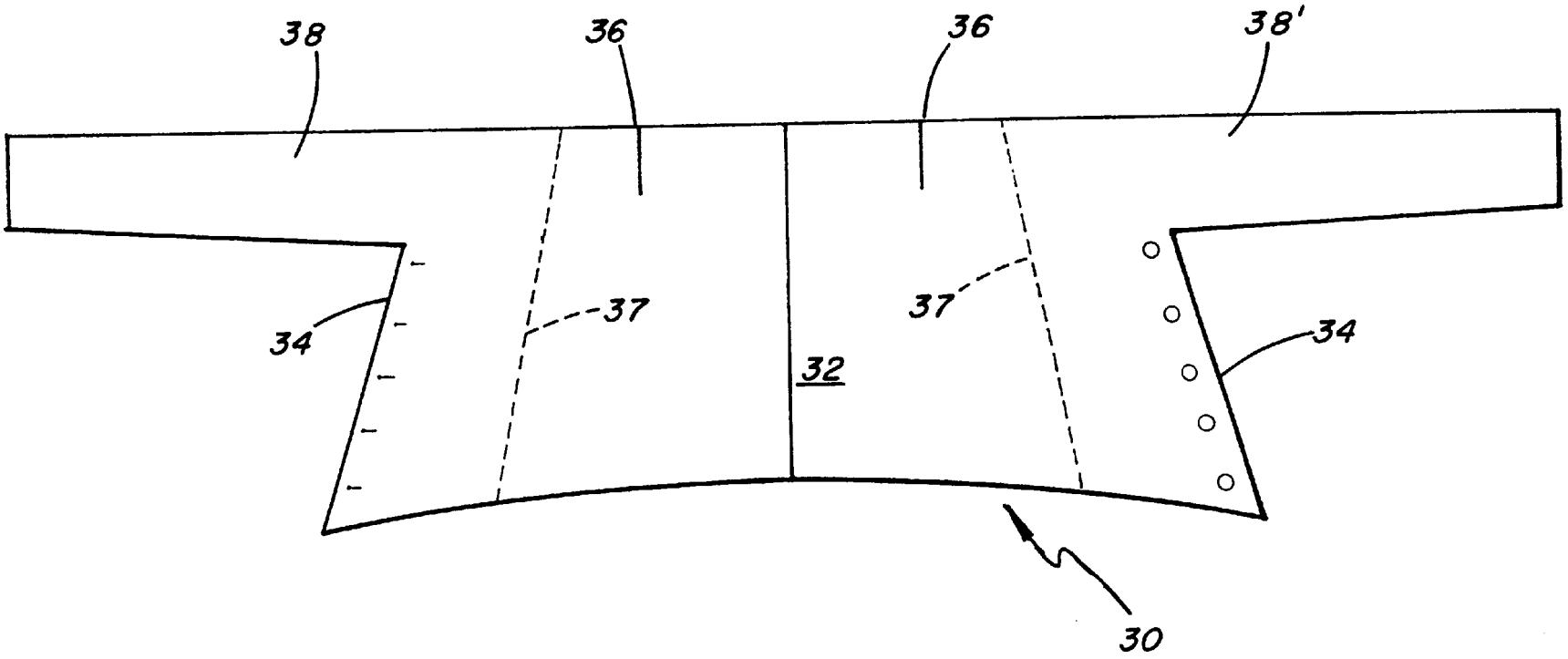
FIG. 2 is a plan view of a pattern of an alternative embodiment of the garment of the present invention.

In FIG. 2, there is shown a pattern 30 for a garment according to an alternative embodiment of the present invention. In the embodiment of FIG. 2, the finished garment resembles a cardigan sweater as opposed to the pullover sweater of the preferred embodiment.

The main body panel 32 is generally trapezoidal in shape with a concave arc at the bottom. In the "medium" size embodiment, the top of the body panel 32 is approximately 30" in width and approximately 15" in length at the center. At the edges 34, 34' the length is 18".

As with the preferred embodiments, optional darts 36 can be placed approximately 6" from the center line. An optional side seam 37 can be provided near the vertical edges of the body panel 32. A pair of ties, 38, 38' are fastened to the edges at the top and, as in the preferred embodiment, are tapered from a width of 5" at the line of attachment to 4" at the free ends.

To maintain the illusion of a cardigan sweater, the left side edge 34 is provided with either buttons 40 or button holes 42. Similarly, the right side edge 34' is provided with button holes 42 or buttons 40 so that the finished garment creates the appearance of a cardigan sweater, with buttons. As with the preferred embodiment, when a double layer of fabric is provided, the bottom should not be sewn or seamed together.

Thus there has been shown and described a novel garment capable of making a fashion statement. However the invention should be limited only by the scope of the claims appended hereto.

What as claimed as new is:

1. A shawl type garment adapted to simulate a sweater comprising:

a. a generally rectangular main body panel having top, bottom and side edges;

b. a first tie element secured to one side of said body panel near said top edge thereof; and c. a second tie element secured to the other side of said body panel near said top edge thereof whereby said body panel can be wrapped about a wearer as a shawl type garment and secured in place by tying said first and second tie elements together at a desired location on the wearer's body.

2. The shawl type garment of claim 1 wherein said body panel includes dart elements terminating at said top edge thereof.

3. The shawl type garment of claim 1 wherein said body panel is comprised of a single thickness of fabric.

4. The shawl type garment of claim 1 wherein said body panel is comprised of two fabric layers.

5. The shawl type garment of claim 4 wherein said fabric layers have different appearance characteristics so that the garment is reversible to provide a different appearance depending upon which fabric layer is outermost.

6. The shawl type garment of claim 1 wherein said body panel is comprised of a knitted fabric, giving the appearance of a sweater.

7. The shawl type garment of claim 6 wherein said body panel includes a plurality of buttons arranged along one side edge of said body panel and a plurality of button holes arranged along the opposite side edge of said body panel, simulating the appearance of a cardigan sweater.

8. A shawl type garment adapted to simulate a sweater comprising:

a. a generally rectangular main body panel having top, bottom and side edges said body panel being made from two layers of a knitted fabric giving the appearance of a sweater;

b. a first tie element secured to one side of said body panel near said top edge thereof; and c. a second tie element secured to the other side of said body panel near said top edge thereof whereby said body panel can be wrapped about a wearer as a shawl type garment and secured in place by tying said first and second tie elements together at a desired location on the wearer's body.

9. The shawl type garment of claim 6 wherein said tie elements are made from the same knitted fabric as said main body panel.

10. A shawl type garment adapted to simulate a sweater comprising:

a. a generally rectangular main body panel having top, bottom and side edges, said body panel being cut from a fabric material slightly off grain of the straight of goods to minimize cupping at said bottom edge of said panel;

b. a first tie element secured to one side of said body panel near said top edge thereof; and c. a second tie element secured to the other side of said body panel near said top edge thereof whereby said body panel can be wrapped about a wearer as a shawl type garment and secured in place by tying said first and second tie elements together at a desired location on the wearer's body.

11. A shawl type garment adapted to simulate a sweater comprising:

a. a generally trapezoidal main body panel having top, bottom and side edges with said bottom edge longer than said top edge, said bottom edge having a concave arc;

b. a first tie element secured to one side of said body panel near said top edge thereof; and c. a second tie element secured to the other side of said body panel near said top edge thereof whereby said body panel can be wrapped about a wearer as a shawl type garment and secured in place by tying said first and second tie elements together at a desired location on the wearer's body.

12. The shawl type garment of claim 11 wherein said body panel includes dart elements terminating at said top edge thereof.

13. The shawl type garment of claim 11 wherein said body panel is comprised of a single thickness of fabric.

14. The shawl type garment of claim 11 wherein said body panel is comprised of two fabric layers.

15. The shawl type garment of claim 11 wherein said fabric layers have different appearance characteristics so that the garment is reversible to provide a different appearance depending upon which fabric layer is outermost.

16. The shawl type garment of claim 11 wherein said body panel is comprised of a knitted fabric, giving the appearance of a sweater.

17. The shawl type garment of claim 16 wherein said body panel includes a plurality of buttons arranged along one side edge of said body panel and a plurality of button holes arranged along the opposite side edge of said body panel, simulating the appearance of a cardigan sweater.

18. The shawl type garment of claim 16 wherein said body panel is made from two layers of a knitted fabric.

19. The shawl type garment of claim 16 wherein said tie elements are made from the same knitted fabric as said main body panel.

20. The shawl type garment of claim 11 wherein said body panel is cut from a fabric material slightly off grain of the straight of goods to minimize cupping at said bottom edge of said panel.

* * * * *